US006682135B2

(12) United States Patent
Zheng

(10) Patent No.: US 6,682,135 B2
(45) Date of Patent: Jan. 27, 2004

(54) TENSIONAL SEAT SUPPORT ARRANGEMENT FOR COLLAPSIBLE CHAIR

(76) Inventor: Edward Zheng, 1736 Wright Ave., La Verne, CA (US) 91750

( * ) Notice: Subject to any disclaimer, the term of this patent is extended or adjusted under 35 U.S.C. 154(b) by 112 days.

(21) Appl. No.: 09/956,517

(22) Filed: Sep. 18, 2001

(65) Prior Publication Data

US 2003/0052518 A1 Mar. 20, 2003

(51) Int. Cl.[7] ..... A47C 4/00
(52) U.S. Cl. ..... 297/16.2; 297/45
(58) Field of Search ..... 297/16.1, 16.2, 297/35, 39, 45, 46, 55, 56

(56) References Cited

U.S. PATENT DOCUMENTS 5,984,406 A * 11/1999 Lee ..... 297/16.2
6,209,951 B1 * 4/2001 Han
6,247,749 B1 * 6/2001 Yu ..... 297/16.2
6,322,138 B1 * 11/2001 Tang ..... 297/45
6,382,715 B1 * 5/2002 Tang ..... 297/16.2
6,454,348 B1 * 9/2002 Wu ..... 297/16.2

* cited by examiner

*Primary Examiner*—Peter R. Brown
*Assistant Examiner*—Stephen Vu
(74) *Attorney, Agent, or Firm*—Raymond Y. Chan; David and Raymond Patent Group

(57) ABSTRACT

A tensional support arrangement includes a pair of guiding holders rotatably connected to back supporting frame legs respectively and a pair of side supporting arms, which are positioned at two outer sides of a chair frame, each has a support portion pivotally connected to the respective front joint at a front end thereof and a guiding portion slidably connected to the respective guiding holder, wherein two side edge portions of a seat fabric are substantially supported by the support portions of the side supporting arms respectively. Therefore, the tensional support arrangement is capable of substantially increasing the supporting area of the fabric seat to more evenly distribute and support the downward pulling force and stress applied by the user's weight.

30 Claims, 7 Drawing Sheets

TENSIONAL SEAT SUPPORT ARRANGEMENT FOR COLLAPSIBLE CHAIR

BACKGROUND OF THE PRESENT INVENTION

1. Field of Invention

The present invention relates to a collapsible chair, and more particularly to a tensional seat support arrangement for collapsible chair which provides the user of the collapsible chair with two sides of seat support.

2. Description of Related Arts

Referring to FIG. 1 of the drawings, a conventional foldable chair comprises a foldable chair frame A1 constructed by metal tubes and a seat fabric B1. The foldable chair frame A1 comprises a plurality of construction tubes A11 to construct a back supporting frame A2 and a seat frame A3 for supporting the fabric seat B1. The seat frame A3 comprises a front pair, a back pair, and two side pairs of the construction tubes, wherein each pair of the construction tubes are pivotally connected together where they cross so that the chair frame A1 can be easily unfolded to provide a rigid cross-support for use and be folded up for storage. Since the conventional foldable chair can be quickly and easily unfolded for use and folded into a compact for carriage, the user can carry the foldable chair to everywhere such as campground or beach.

However, the conventional foldable chair has a major drawback. Since the seat portion of the seat fabric B1 is suspendedly supported by the seat frame A3, the seat fabric B1 may not be substantially supported. When the user sits on the seat fabric B1, the downward pulling force is applied on the seat portion of the seat fabric such that the seat portion will be stretched to the center thereof. Therefore, most of the users of the conventional foldable chair have an intention to plunge into the chair frame downwardly.

Besides, stresses are created by the downward pulling force at the connecting joints where the seat fabric B1 is connected with the chair frame A1. The user's weight causes the seat fabric B1 to be pulled away from the connecting joints such that the stresses will be created at the connecting joints. The stress created will then cause a tear along the area of the seat fabric B1 at the connecting joint so that the seat fabric B1 will be permanently misshapen at the stress point over a period of continuous use.

SUMMARY OF THE PRESENT INVENTION

A main object of the present invention is to provide a tensional seat support arrangement for collapsible chair, wherein the user's hip and thigh can be well supported such that the collapsible chair is more comfortable and capable of supporting more weight in comparison with the conventional chair frame that has same frame structure and size.

Another object of the present invention is to provide a tensional seat support arrangement for collapsible chair which substantially increases the supporting contact-area of the fabric seat to more evenly distribute and support the downward force and stress applied by the user's weight.

Another object of the present invention is to provide a tensional seat support arrangement for collapsible chair, wherein two side portions of seat support fabric are substantially supported by two foldable side supporting arms respectively in such a manner that the user is allowed to sit on the fabric seat without distorting the shape of the fabric seat.

Another object of the present invention is to provide a tensional seat support arrangement for collapsible chair, wherein the two side supporting arms do not increase the distance between the front frame legs and the back supporting frame legs, i.e. the folding size of the chair frame. In other words, the collapsible chair of the present invention is adapted for being folded into a compact unit for carriage and storage and unfolded for use as usual.

Another object of the present invention is to provide a tensional seat support arrangement for collapsible chair, which does not require altering the original structural design of the collapsible chair, so as to minimize the manufacturing cost of the collapsible chair incorporating with the tensional support arrangement.

Accordingly, in order to accomplish the above objects, the present invention provides a collapsible chair, comprising:

- a chair frame, which comprises a seat frame comprising:
  - two side frames each comprising a first frame leg and a second frame leg pivotally coupled with each other to form a "X" structure,
  - a front frame comprising a first front frame leg and a second frame leg pivotally coupled with each other to form a "X" structure,
  - a rear frame comprising a first rear frame leg and a second rear frame leg pivotally coupled with each other to form a "X" structure,
  - a pair of front frame joints pivotally connected with two upper ends of the first frame legs and two upper ends of the two front frame legs respectively,
  - a pair of back supporting frame joints pivotally connected with two upper ends of the second frame legs and two upper ends of the two rear frame legs respectively, and
  - a back supporting frame comprising a pair of back supporting frame legs upwardly extended through the two back supporting frame joints respectively; and
  - a tensional support arrangement, which comprises:
    - a pair of guiding holders provided at the two back supporting frame legs respectively; and
    - a pair of side supporting arms, which are positioned at two outer sides of the seat frame, wherein each of the side supporting arms has a support portion which front end is pivotally connected to the respective front joint and a guiding portion which is rearwardly extended from the support portion and slidably supported by the respective guiding holder; and
    - a seat fabric, which is attached to the chair frame by mounting on the front and back frame joints, having two side edge portions substantially supported by the support portions of the side supporting arms respectively.

BRIEF DESCRIPTION OF THE DRAWINGS

FIG. 7 is an alternative mode of the front joint of the collapsible chair according to the above preferred embodiment of the present invention.

DETAILED DESCRIPTION OF THE PREFERRED EMBODIMENT

Figure 1:
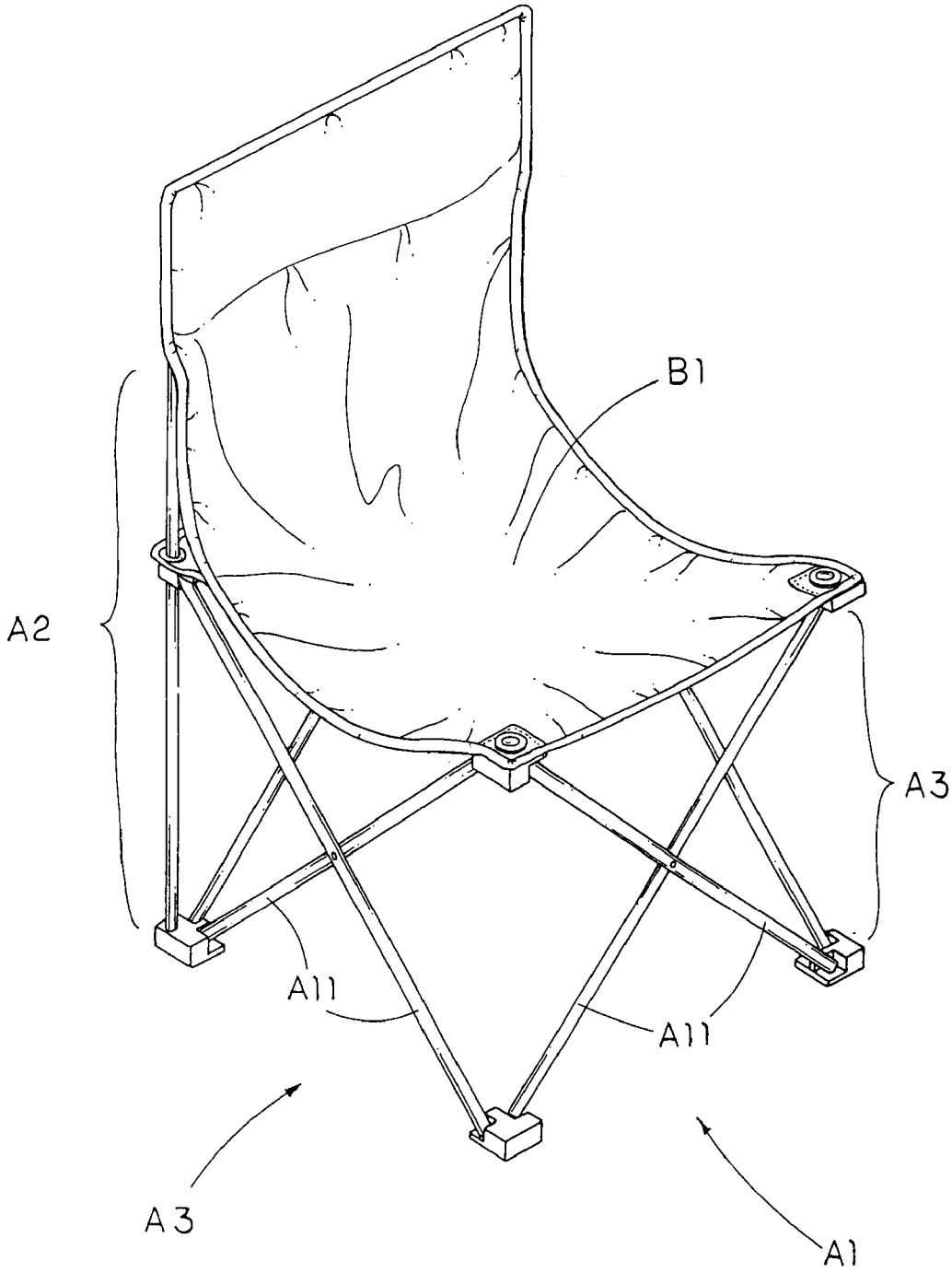
FIG.1 PRIOR ART
FIG. 1 is a perspective view of a conventional foldable chair.
Figure 2:
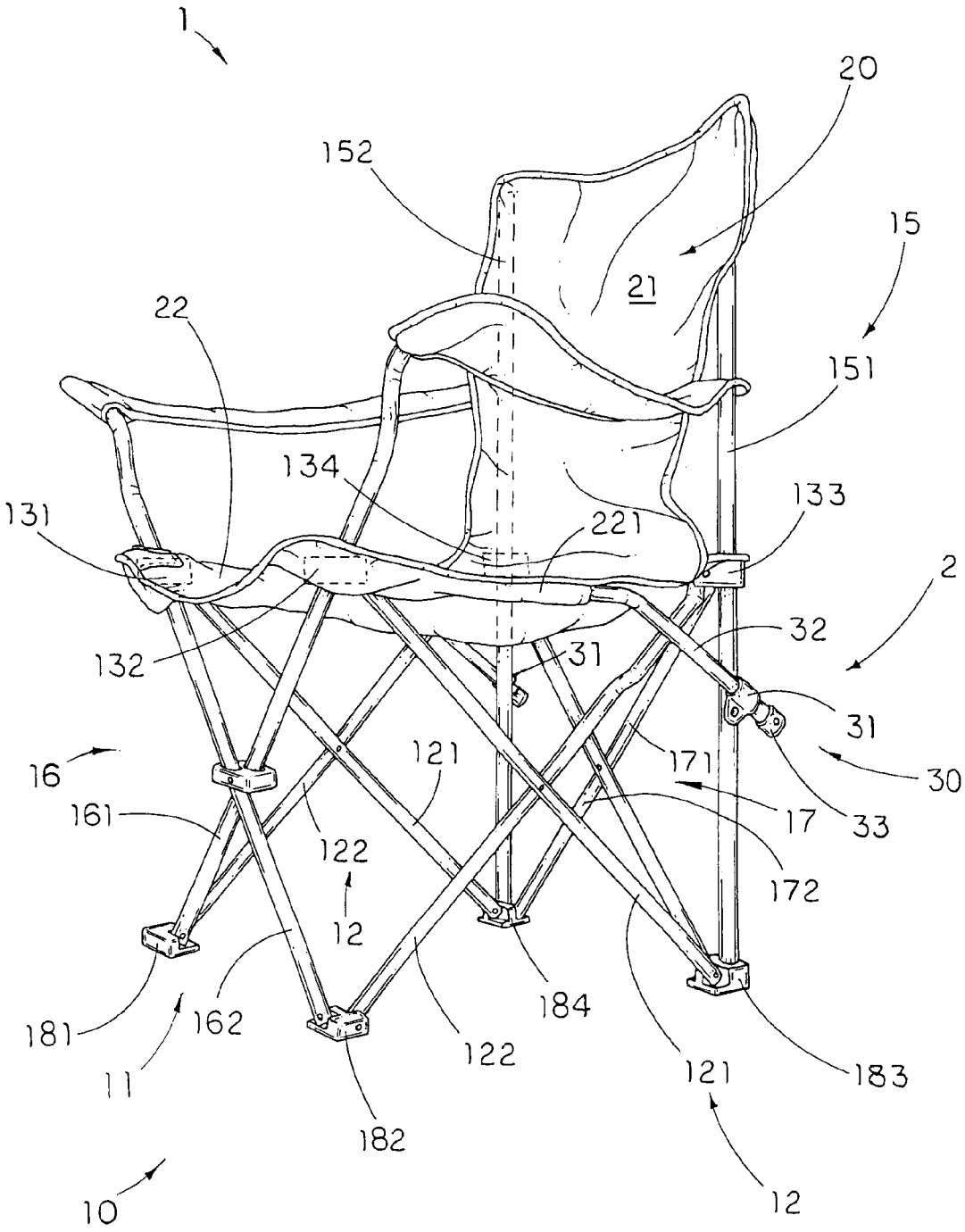
FIG. 2 is a perspective view of a collapsible chair incorporated with a tensional support arrangement according to a preferred embodiment of the present invention.

Referring to FIG. 2 of the drawings, a collapsible chair 1 incorporated with a tensional support arrangement 2 according to a preferred embodiment of the present invention is illustrated, wherein the collapsible chair comprises a chair frame 10 to support a fabric seat 20 thereon.

The chair frame 10 comprises a seat frame 11 which comprises two side frames 12 each comprising a first frame leg 121 and a second frame leg 122 pivotally coupled with each other to form a "X" structure, a pair of front frame joints 131, 132 pivotally connected with two upper ends of the first frame legs 121 respectively, a pair of back supporting frame joints 133, 134 pivotally connected with two upper ends of the second frame legs 122 respectively, and a back supporting frame 15 comprising a pair of back supporting frame legs 151, 152 upwardly extended through the two back supporting frame joints 133, 134 respectively.

The chair frame 10 further comprises a front frame 16 comprising a pair of front frame legs 161, 162 pivotally connected together to form a "X" structure and a rear frame 17 comprising a pair of rear frame legs 171, 172 pivotally connected together to form a "X" structure. Four upper ends of the front and rear frame legs 161, 162, 171, 172 are pivotally connected to the two front frame joints 131, 132 and two back supporting frame joints 133, 134 respectively.

The chair frame 10 further comprises four base frame joints 181, 182, 183, 184. The first and second base frame joints 181, 182 pivotally connect the bottom ends of the front frame legs 161, 162 and the second side frame legs 122 respectively. The third and fourth base frame joints 183, 184 pivotally connect the bottom ends of the rear frame legs 171, 172 and the first side frames 121 respectively. Furthermore, the bottom ends of the back supporting frame legs 151, 152 are pivotally connected to the third and fourth base joints 183, 184 respectively.

Figure 3:
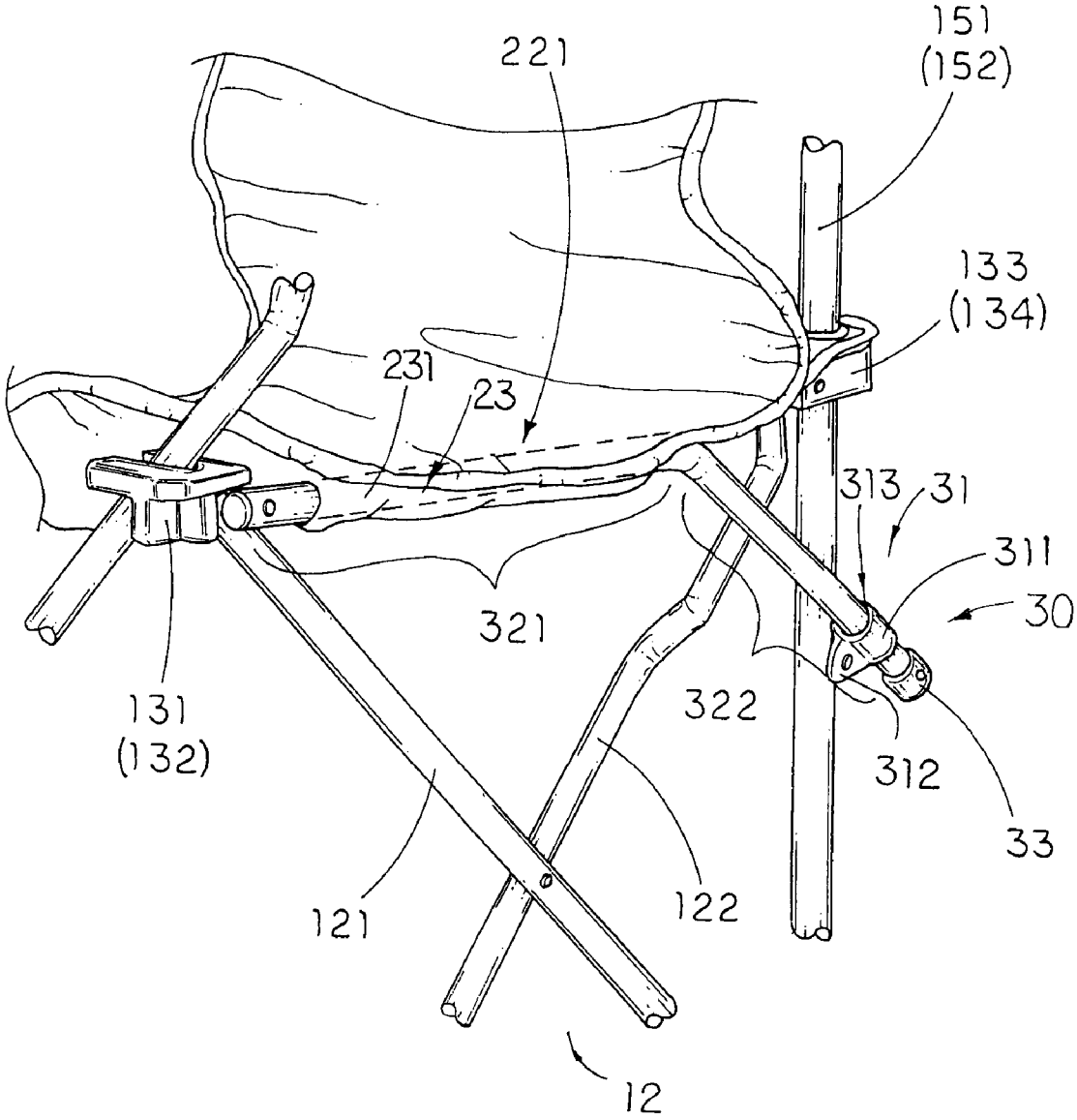
FIG. 3 is a perspective view of the tensional seat support arrangement for collapsible chair according to the above preferred embodiment of the present invention.

As shown in FIG. 3, the tensional support arrangement 30 comprises a pair of guiding holders 31 rotatably connected to the two back supporting frame legs respectively and a pair of side supporting arms 32, which are positioned at two outer sides of the chair frame 10. Each of the side supporting arms 32 has a support portion 321 which front end is pivotally connected to the respective front joint 131, 132 and a guiding portion 322 which is rearwardly extended from the support portion 131 and slidably supported by the respective guiding holder 31.

The fabric seat 20 comprises a back fabric 21 supported by the back supporting frame 15 and a seat fabric 22 supported by the seat frame 11, wherein two side edge portions 221 of the seat fabric 22 are substantially supported by the support portions 321 of the side supporting arms 32 respectively.

According to the preferred embodiment, as shown in FIG. 3, each of the guiding holders 31 comprises a tubular slider body 311 and a connecting wing 312 integrally extended from one side of the slider body 311. Each of the slider bodies 311 is rotatably mounted on a predetermined position of the respective back supporting frame legs 151, 152 below the back frame joints 133, 134 by pivotally riveting the connecting wing 312 to the respective back supporting frame legs 151, 152, wherein the slider body 311 has an axial slider through slot 313 which has a diameter slightly larger than a diameter of the respective side supporting arm 32 for the guiding portion 322 of the respective side supporting arm 32 slidably passing through.

The side supporting arms 32 can be supporting tubular legs made of the similar material of the other frame legs of the chair frame 10. Each of the side supporting arms 32 has a first elongated portion forming the front portion 321 which front end is pivotally connected to the respective front joint 131, 132, and a second bent portion which is inclined with respect to the front portion 321 to form the guiding portion 322 that is slidably supported by the guiding holder 31 by slidably penetrating through the slider through slot 313.

Figure 5:
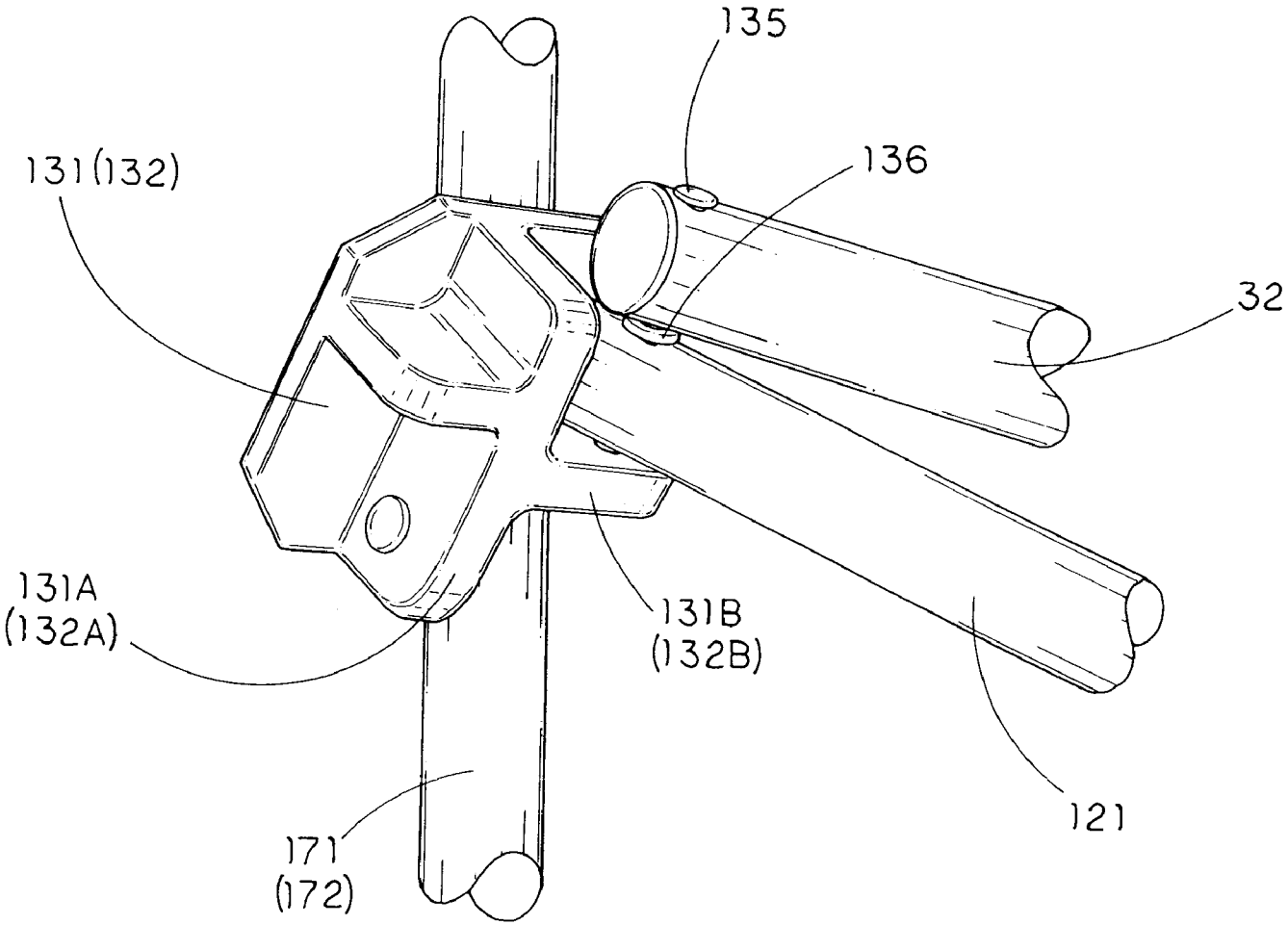
FIG. 5 is a perspective view of a front joint of the collapsible chair according to the above preferred embodiment of the present invention.

Referring to FIG. 5, each of the front frame joints 131, 132 comprises a first pivot wall 131*a*, 132*a* extended downwardly for pivotally connecting one of the front frame legs 171, 172 and a second pivot wall 131*b*, 132*b* extended downwardly for pivotally connecting the first frame leg 121 of the side frame 12 via a rivet 135 wherein the side supporting arm 32 is pivotally connecting to an outer side of the first frame leg 121 via the same rivet 135. In other words, the first frame leg 121 is sandwiched between the second pivot wall 131*b*, 132*b* and the side supporting arm 32. Thus, a washer 136 is used to mount on the rivet 135 between the first frame leg 121 and the side supporting arm 32 to enhance the individual pivot movement of the frame leg 121 and the side supporting arm 32 respectively.

The guiding holder 31 is arranged to guide the side supporting arm 32 between a folded position and an unfolded position. When the collapsible chair 1 is folded up, as shown in FIG. 6B, the side supporting arms 32 are in the folded position that two rear ends of the guiding portions 322 of the side supporting arms 32 are respectively slid away from the two guiding holders 31 until the guiding holders 31 are slid on the guiding portions 322 and towards the support portions 321 respectively, wherein the slider through slots 313 of the slider bodies of the guiding holders 31 are rotated to a vertical position due to the downward movement of the guiding portions 322 of the side supporting arms 32. As described above, the fronts end of the side supporting arms 32 are pivotally connected to the front joints 131, 132 respectively and the guiding portions 322 are guided and supported by the guiding holders 31 respectively, so that when the two front frame 16 and the rear frame 17 are moved towards each other while the collapsible chair 1 is folded up, the support portions 321 are inclinedly extended between the front joints 131, 132 and the guiding holders 31 while the guiding portion 322 is vertically extended from the guiding holders 31 downwardly. Accordingly, the folded size of the collapsible chair 1 will not increased after incorporating the tensional supporting arrangement 2. In other words, due to the bent-structure of the side supporting arms 32, the side supporting arms 32 do not increase the distance between the front frame legs 161, 162 and the rear frame legs 171, 172, i.e. the folding size of the chair frame 10. Accordingly, the collapsible chair 1 of the present invention incorporated with the tensional support arrangement 2 is adapted for being folded into a compact unit for carriage and storage and unfolded for use.

Figure 6A:
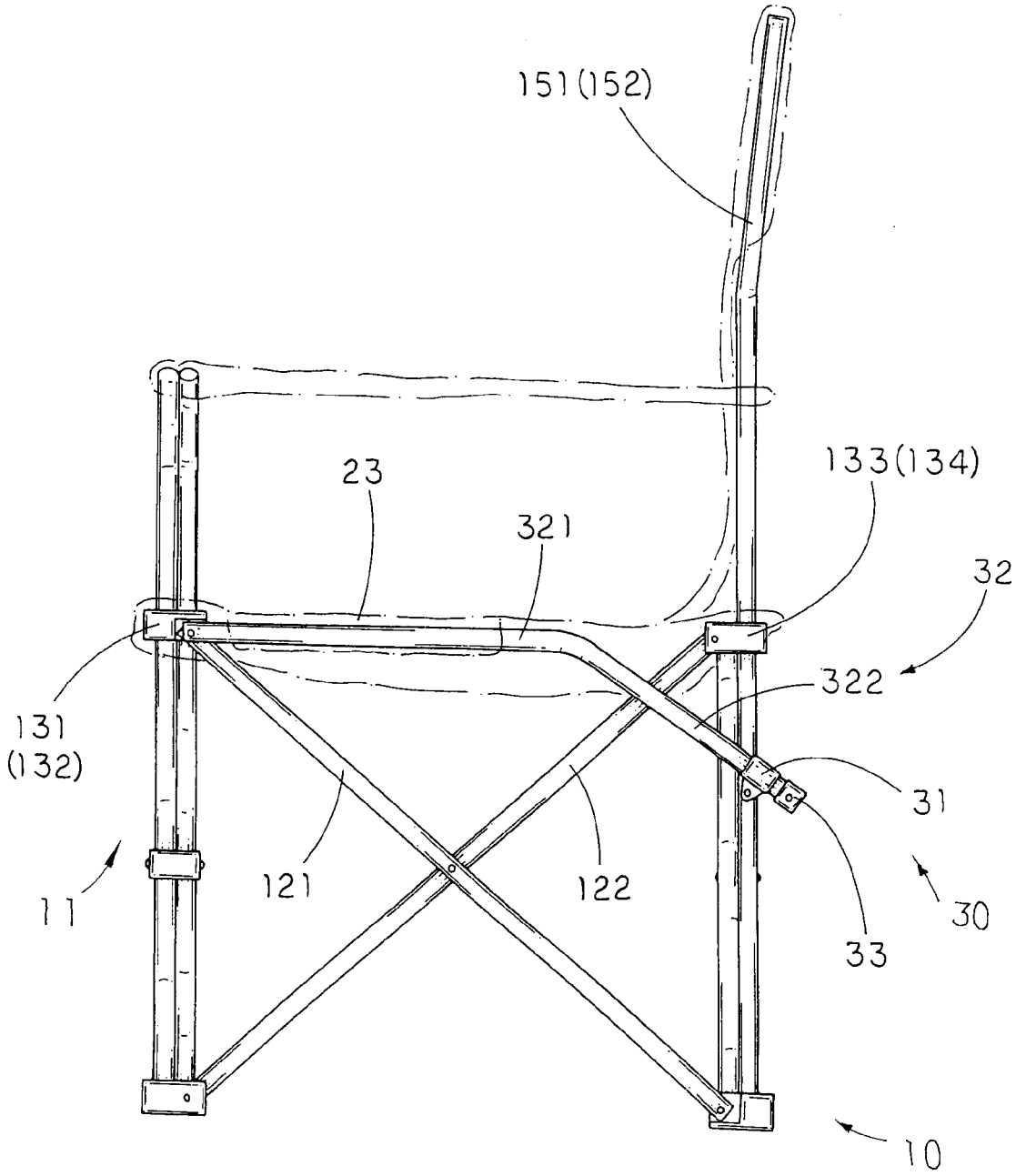
FIG. 6A is a side view of the collapsible chair in an unfolded position according to the above preferred embodiment of the present invention.
Figure 6B:
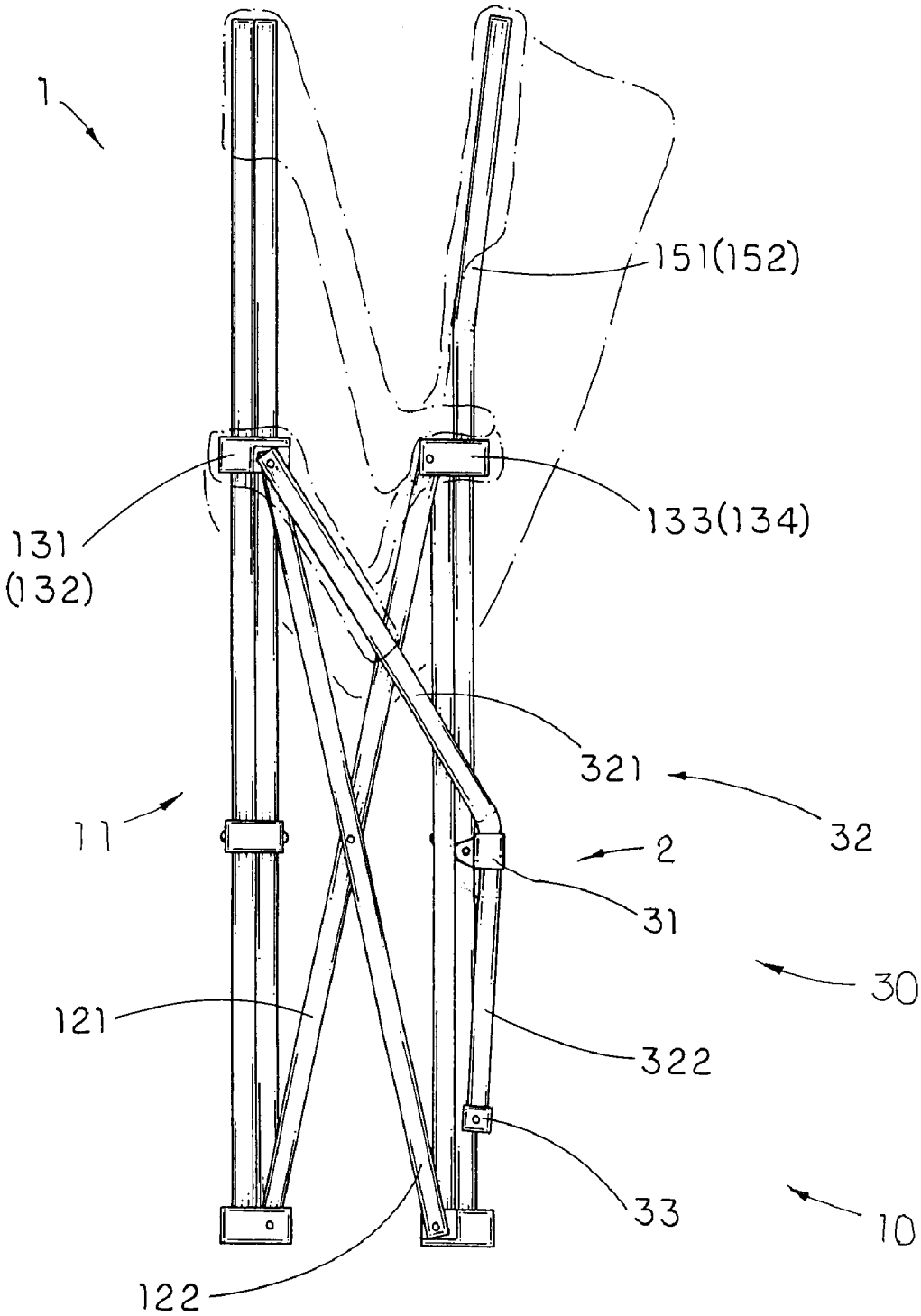
FIG. 6B is side view of the collapsible chair in a folded position according to the above preferred embodiment of the present invention.

When the collapsible chair 1 is unfolded, as shown in FIGS. 2 and 6A, the side supporting arms 32 are in the unfolded position that two rear ends of the guiding portions 322 of the side supporting arms 32 are respectively slid towards the two guiding holders 31 until the guiding holders 31 are positioned near the rear ends of the guiding portions 322 respectively. As mentioned above, since the fronts end of the side supporting arms 32 are pivotally connected to the front joints 131, 132 respectively and the guiding portions 322 are respectively guided and supported by the guiding holders 31 which are uplifted to a slant position as shown in FIGS. 2, 3 and 6A, the side supporting arms 32 are well supported between the front frame 16 and the rear frame 17 when the collapsible chair 1 is unfolded for use, wherein the supporting portion is horizontally extended rearwardly from the front joints 131, 132 while the guiding portion 322 is extended from the guiding holders 31 inclinedly and downwardly. In which, the unfolded size of the collapsible chair 1 will not increased after incorporating the tensional supporting arrangement 2.

Figure 4:
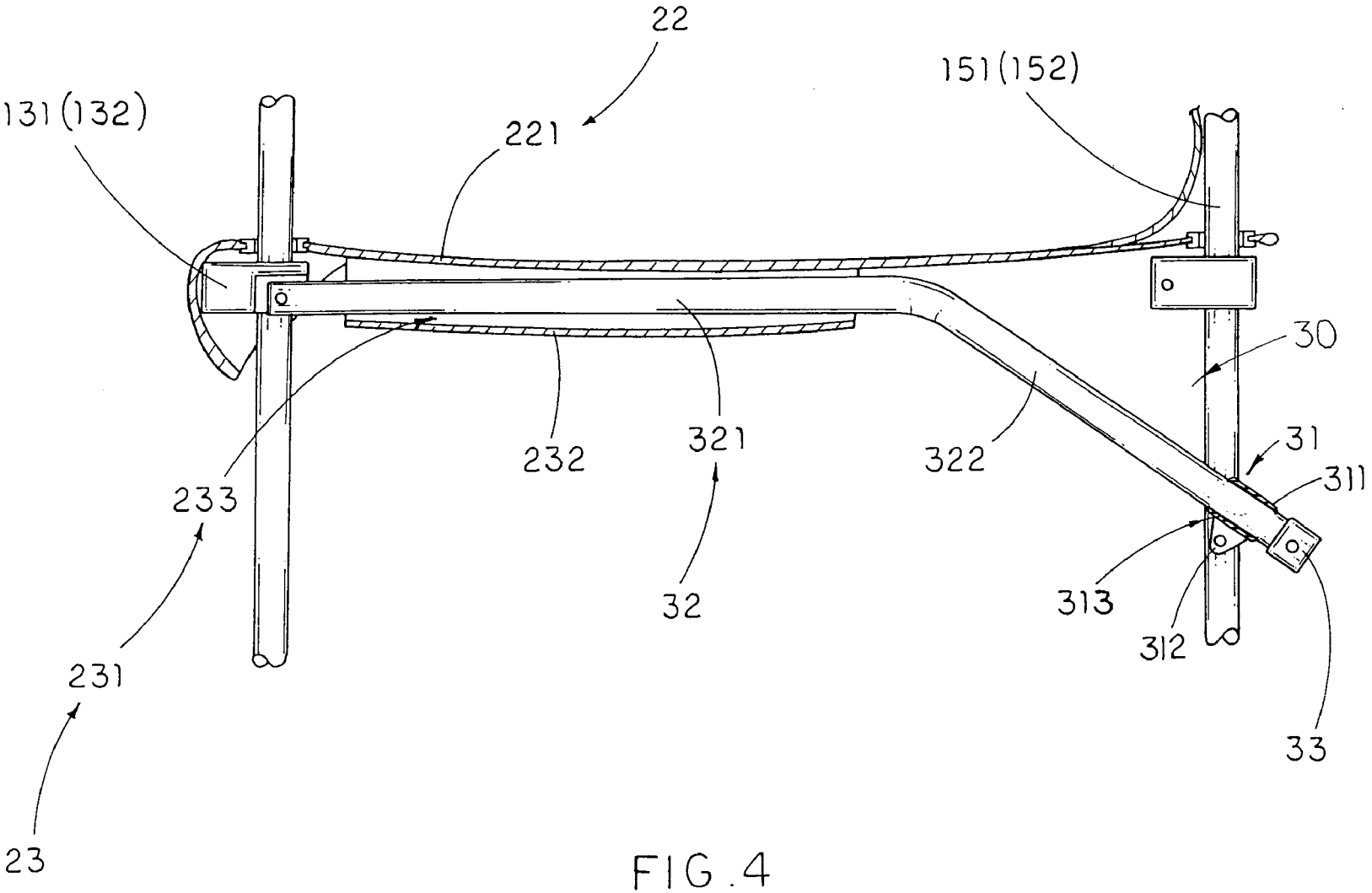
FIG. 4 is a sectional view of the tensional seat support arrangement for collapsible chair according to the above preferred embodiment of the present invention.

As shown in FIG. 4, the guiding portions 322 of the side supporting arms 32 are respectively inclinedly extended from the support portions 321 thereof in a slant and downward manner, wherein the guiding holders 31 are arranged to slide through the guiding portions 322 to guide and drive the support portions 321 in a pivotally movable manner with respect to the front frame joints 131, 132 respectively.

According to the FIGS. 3 and 4, the fabric seat 20 further comprises a pair of holding means 23 for holding the two side portions 221 of the seat fabric 22 with the support portions 322 of the two side supporting arms 32 respectively, wherein each holding means 23 comprises at least a tubular holding sleeve 231, having two open ends, provided on each side portion 221 of a bottom surface of the seat fabric 22 for the support portion 321 of the side supporting arm 32 slidably passing through.

As shown in FIGS. 2, 4, and 6A, the two side supporting arms 32 are extended along the two side portions 221 of the seat fabric 22 respectively so as to substantially support the two side portions 221 that ensures the two thighs of the user who sits on the seat fabric 22 of the collapsible chair 1 being in contact with two side portions 221 and being supported by the two side supporting arms 32. In which, the two side supporting arms 32 can more evenly distribute and support the downward force and stress applied by the user's weight, so that the user is allowed to more comfortably sit on the collapsible chair 1 without distorting the shape of the seat fabric 22.

Accordingly, each of the tubular holding sleeves 231 is made of durable fabric material such as nylon or polyester. In order to form the tubular holding sleeve 231, two opposed longitudinal edges of an elongated reinforcing strap 232 are firmly affixed on the respective side portion 221 of the bottom surface of the seat fabric 22 by stitching so as to form an elongated holding through hole 233 between the seat fabric 22 and the reinforcing strap 232 for the side supporting arm 32 passing therethrough.

It is worth to mention that when the collapsible chair 1 is unfolded, inward movement of the two side supporting arms 32 are limited and blocked up by the two side frames 12 respectively. As shown in FIG. 3, the support portion 321 of each side supporting arm 32 is biased against the respective second frame leg 122 of the side frame 12, so as to block up the side supporting arm in an inward lateral movement with respect to the chair frame 10. Practically, the user's downward weight has a trend of pulling the two side supporting arms 32 towards each other and a trend of pushing the two side frames 12 away from each other but such inward movement of the side supporting arms 32 is blocked by side frames 12 that substantially provides a rigid construction for the collapsible chair, especially when the user is sitting thereon.

In other words, the two side supporting arms 32 can enhance the tension of the seat fabric 22 by reinforcing the two side portions 221 thereof, that substantially increases the effective supporting contact-area of the seat fabric 22. Besides, the downward pulling force applied by the user's weight will distribute from the fabric seat 20 to the entire chair frame 10 through the side supporting arms 32 so that the collapsible chair 1 is more comfortable and capable of supporting more weight in comparison with the conventional chair frame having same frame structure and size.

The tensional support arrangement 2 further comprises a pair of stoppers 33 affixed to rear ends of the guiding portions 322 of the side supporting arms 32 respectively for blocking up the sliding movement of the guiding holder 31, so as to prevent the guiding holder 31 from sliding out of the side supporting arm 32 anytime. Accordingly, each of the stoppers 33 is a cap affixed at the rear end of the respective side supporting arm 32 wherein a screw is used to fasten the stopper 33 to the rear end of the guiding portion 322.

FIG. 7 illustrates an alternative mode of the front frame joint 131', 132' wherein each of the front frame joints 131', 132' comprises a first pivot wall 131*a*', 132*a*', extended downwardly for pivotally connecting one of the front frame legs 171', 172' and a second pivot wall 131*b*', 132*b*' extended downwardly for pivotally connecting the first frame leg 121' of the side frame 12' and the side supporting arm 32' via a rivet 135'. In other words, the second pivot wall 131*b*', 132' is sandwiched between the first frame leg 121' and the side supporting arm 32'. Since the side supporting arm 32' is positioned at the outer side of the seat frame 11', the front frame joint 131', 132' further comprises a retaining washer 136' having a predetermined thickness mounted on the rivet 135' between the second pivot wall 131*b*', 132*b*' and the side supporting arm 32' for lengthening a distance therebetween, so as to retain the side supporting arm 32' positioned at the outer side of the seat frame 11'.

What is claimed is:

1. A collapsible chair, comprising:

a chair frame, having a seat frame comprising:

two side frames, each comprising a first frame leg and a second frame leg pivotally coupled with each other to form an x-shape structure, a front frame comprising a first frame leg and a second frame leg pivotally coupled with each other to form an x-shape structure, a rear frame comprising a first rear frame leg and a second rear frame leg pivotally coupled with each other to form an x-shaped structure, a pair of front frame joints pivotally connected with two upper ends of said first frame legs and two upper ends of said two front frame legs respectively, a pair of back supporting frame joints pivotally connected with two upper ends of said second frame legs and two upper ends of said two rear frame legs respectively, and a back supporting frame comprising a pair of back supporting frame legs extending upwardly through said two back supporting frame joints respectively; and a tensional support arrangement, which comprises:

a pair of guiding holders provided at said two back supporting frame legs respectively; and a pair of side supporting arms, which are positioned at two outer sides of said seat frame, wherein each of said side supporting arms has a support portion having a front end pivotally connected to said respective front joint and a guiding portion which is rearwardly extended from said support portion and slidably supported by said respective guiding holder; and a seat fabric, which has two side edge portions, being attached to said chair frame by mounting on said front and back frame joints, wherein said two support portions of said two side supporting arms are extended along said two side portions of said seat fabric respectively to substantially support said seat fabric between said two side supporting arms.

2. The collapsible chair, as recited in claim 1, wherein each of said guiding holders comprises a slider body rotatably mounted to a predetermined position of said respective back supporting frame legs below said back frame joints, wherein each of said slider bodies has a slider through slot arranged for said guiding portion of said respective side supporting arm slidably passing through.

3. The collapsible chair, as recited in claim 2, wherein each of said guiding holders further comprises a connecting wing, which is integrally extended from one side of said respective slider body, and pivotally riveted to said respective back supporting frame legs.

4. The collapsible chair, as recited in claim 3, wherein each of said side supporting arms is a tubular leg having a first elongated portion forming said front portion, wherein a front end is pivotally connected to said respective front joint, and a second bent portion which is inclined with respect to said front portion to form said guiding portion that is slidably supported by said guiding holder by slidably penetrating through said slider through slot, wherein said guiding holder is arranged to guide said side supporting arm between a folded position and an unfolded position, whereby when said two front frame and said rear frame are moved towards each other while said collapsible chair is folded up, said side supporting arms are in said folded position so that two rear ends of said guiding portions of said side supporting arms are respectively slid away from said two guiding holders until said guiding holders are slid on said guiding portions and towards said support portions respectively, wherein said support portions are inclinedly extended between said front joints and said guiding holders while said guiding portion is vertically downwardly extended from said guiding holders;

when said collapsible chair is unfolded, said side supporting arms are in said unfolded position so that two rear ends of said guiding portions of said side supporting arms are respectively slid towards said two guiding holders until said guiding holders are positioned near said rear ends of said guiding portions respectively, wherein said side supporting arms are well supported between said front frame and said rear frame when said collapsible chair is unfolded for use, wherein said supporting portion is horizontally extended rearwardly from said front joints while said guiding portion is extended from said guiding holders inclinedly and downwardly.

5. The collapsible chair, as recited in claim 4, wherein said fabric seat further comprises a pair of holding devices holding said two side portions of said seat fabric with said support portions of said two side supporting arms, respectively.

6. The collapsible chair, as recited in claim 4, wherein said two side supporting arms are positioned at two outer sides of said two side frames respectively, wherein said support portion of each of said side supporting arms is biased against said respective second frame leg of said side frame, so as to block up said side supporting arm in an inwardly lateral movement with respect to said chair frame.

7. The collapsible chair, as recited in claim 6, wherein said fabric seat further comprises a pair of holding devices holding said two side portions of said seat fabric with said support portions of said two side supporting arms, respectively.

8. The collapsible chair, as recited in claim 7, wherein each of said holding devices comprises at least a tubular holding sleeve, having two open ends, provided on each side portion of a bottom surface of said seat fabric for said support portion of said side supporting arm slidably passing through.

9. The collapsible chair, as recited in claim 8, wherein each of said tubular holding sleeves comprises an elongated reinforcing strap having two opposed longitudinal edges firmly affixed on said respective side portion of said bottom surface of said seat fabric by stitching, so as to form an elongated holding through hole between said seat fabric and said reinforcing strap for said respective side supporting arm passing therethrough.

10. The collapsible chair, as recited in claim 9, wherein each of said front frame joints comprises a first pivot wall extending downwardly for pivotally connecting one of said front frame legs and a second pivot wall extending downwardly for pivotally connecting said first frame leg of said side frame wherein said side supporting arm is pivotally connecting to an outer side of said first frame leg.

11. The collapsible chair, as recited in claim 9, wherein each of said front frame joints comprises a first pivot wall extending downwardly for pivotally connecting one of said front frame legs and a second pivot wall extending downwardly for pivotally connecting said first frame leg of said side frame and said side supporting arm.

12. The collapsible chair, as recited in claim 2, wherein each of said side supporting arms is a tubular leg having a first elongated portion forming said front portion, wherein a front end is pivotally connected to said respective front joint, and a second bent portion which is inclined with respect to said front portion to form said guiding portion that is slidably supported by said guiding holder by slidably penetrating through said slider through slot.

13. The collapsible chair, as recited in claim 2, wherein said two side supporting arms are positioned at two outer sides of said two side frames respectively, wherein said support portions of said side supporting arms are respectively biased against said second frame legs of said two side frames and extended respectively between said two front frame joints and said two back supporting frame joints, so as to block up said side supporting arm in an inwardly lateral movement with respect to said chair frame.

14. The collapsible chair, as recited in claim 13, wherein said fabric seat further comprises a pair of holding devices connecting said two side portions of said seat fabric with said support portions of said two side supporting arms, respectively.

15. The collapsible chair, as recited in claim 14, wherein each of said holding devices comprises at least a tubular holding sleeve, having two open ends, provided on each side portion of a bottom surface of said seat fabric for said support portion of said side supporting arm slidably passing through.

16. The collapsible chair, as recited in claim 15, wherein each of said tubular holding sleeves comprises an elongated reinforcing strap having two opposed longitudinal edges firmly affixed on said respective side portion of said bottom surface of said seat fabric by stitching, so as to form an elongated holding through hole between said seat fabric and said reinforcing strap for said respective side supporting arm passing therethrough.

17. The collapsible chair, as recited in claim 2, wherein said fabric seat further comprises a pair of holding devices connecting said two side portions of said seat fabric with said support portions of said two side supporting arms respectively.

18. The collapsible chair, as recited in claim 17, wherein each of said holding devices comprises at least a tubular holding sleeve, having two open ends, provided on each side portion of a bottom surface of said seat fabric for said support portion of said side supporting arm slidably passing through.

19. The collapsible chair, as recited in claim 18, wherein each of said tubular holding sleeves comprises an elongated reinforcing strap having two opposed longitudinal edges firmly affixed on said respective side portion of said bottom surface of said seat fabric by stitching, so as to form an elongated holding through hole between said seat fabric and said reinforcing strap for said respective side supporting arm passing therethrough.

20. The collapsible chair, as recited in claim 1, wherein said two side supporting arms are positioned at two outer sides of said two side frames respectively, wherein said support portions of said side supporting arms are respectively biased against said second frame legs of said two side frames and extended respectively between said two front frame joints and said two back supporting frame joints, so as to block up said side supporting arm in an inwardly lateral movement with respect to said chair frame.

21. The collapsible chair, as recited in claim 20, wherein said fabric seat further comprises a pair of holding devices connecting said two side portions of said seat fabric with said support portions of said two side supporting arms, respectively.

22. The collapsible chair, as recited in claim 21, wherein each of said holding devices comprises at least a tubular holding sleeve, having two open ends, provided on each side portion of a bottom surface of said seat fabric for said support portion of said side supporting arm slidably passing through.

23. The collapsible chair, as recited in claim 22, wherein each of said tubular holding sleeves comprises an elongated reinforcing strap having two opposed longitudinal edges firmly affixed on said respective side portion of said bottom surface of said seat fabric by stitching, so as to form an elongated holding through hole between said seat fabric and said reinforcing strap for said respective side supporting arm passing therethrough.

24. The collapsible chair, as recited in claim 1, wherein said tensional support arrangement further comprises a pair of stoppers affixed to said rear ends of said guiding portions of said side supporting arms respectively for blocking up said sliding movement of said guiding holder, so as to prevent said guiding holder from sliding out of said side supporting arm.

25. The collapsible chair, as recited in claim 24, wherein said tensional support arrangement further comprises a pair of stoppers affixed to said rear ends of said guiding portions of said side supporting arms respectively for blocking up said sliding movement of said guiding holder, so as to prevent said guiding holder from sliding out of said side supporting arm.

26. The collapsible chair, as recited in claim 1, wherein said fabric seat further comprises a pair of holding device connecting said two side portions of said seat fabric with said support portions of said two side supporting arms, respectively.

27. The collapsible chair, as recited in claim 26, wherein each of said holding devices comprises at least a tubular holding sleeve, having two open ends, provided on each side portion of a bottom surface of said seat fabric for said support portion of said side supporting arm slidably passing through.

28. The collapsible chair, as recited in claim 27, wherein said each of said tubular holding sleeves comprises an elongated reinforcing strap having two opposed longitudinal edges firmly affixed on said respective side portion of said bottom surface of said seat fabric by stitching, so as to form an elongated holding through hole between said seat fabric and said reinforcing strap for said respective side supporting arm passing therethrough.

29. The collapsible chair, as recited in claim 1, wherein each of said front frame joints comprises a first pivot wall extending downwardly for pivotally connecting one of said front frame legs and a second pivot wall extending downwardly for pivotally connecting said first frame leg of said side frame wherein said side supporting arm is pivotally connecting to an outer side of said first frame leg.

30. The collapsible chair, as recited in claim 1, wherein each of said front frame joints comprises a first pivot wall extending downwardly for pivotally connecting one of said front frame legs and a second pivot wall extending downwardly for pivotally connecting said first frame leg of said side frame and said side supporting arm.

* * * * *